US008062154B2

(12) United States Patent
Burger

(10) Patent No.: US 8,062,154 B2
(45) **Date of Patent: *Nov. 22, 2011**

(54) APPARATUS FOR DETERRING MODIFICATION OF SPORTS EQUIPMENT

(75) Inventor: George W. Burger, Rocklin, CA (US)

(73) Assignee: Hillerich & Bradsby, Louisville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/927,047

(22) Filed: Nov. 5, 2010

(65) Prior Publication Data

US 2011/0059820 A1 Mar. 10, 2011

Related U.S. Application Data

(63) Continuation of application No. 12/315,485, filed on Dec. 3, 2008, now Pat. No. 7,850,554.

(51) Int. Cl.
*A63B 59/06* (2006.01)

(52) U.S. Cl. ..... 473/567

(58) Field of Classification Search ..... 473/457, 473/519, 520, 564–568
See application file for complete search history.

(56) References Cited

U.S. PATENT DOCUMENTS 3,861,682 A * 1/1975 Fujii ..... 473/520
3,877,698 A * 4/1975 Volpe ..... 473/520
4,600,193 A * 7/1986 Merritt ..... 473/566
5,094,453 A * 3/1992 Douglas et al. ..... 473/566
5,364,095 A * 11/1994 Easton et al. ..... 473/566
5,676,610 A * 10/1997 Bhatt et al. ..... 473/566
5,759,113 A * 6/1998 Lai et al. ..... 473/321
5,961,405 A * 10/1999 MacKay, Jr. ..... 473/566
5,964,673 A * 10/1999 MacKay, Jr. ..... 473/566
6,042,485 A * 3/2000 Cheng ..... 473/318
6,077,178 A * 6/2000 Brandt ..... 473/520
6,334,825 B1 * 1/2002 Buiatti ..... 473/566
6,398,675 B1 * 6/2002 Eggiman et al. ..... 473/566
6,729,983 B1 * 5/2004 Vakili et al. ..... 473/566
6,949,038 B2 * 9/2005 Fritzke ..... 473/566
6,994,641 B2 * 2/2006 Hebreo et al. ..... 473/520
7,320,653 B2 * 1/2008 Fitzgerald et al. ..... 473/566
7,850,554 B2 * 12/2010 Burger ..... 473/567
7,867,114 B2 * 1/2011 Sutherland et al. ..... 473/567

* cited by examiner

*Primary Examiner* — Mark Graham
(74) *Attorney, Agent, or Firm* — James C. Eaves, Jr.; Greenebaum Doll & McDonald PLLC; Brian W. Chellgren

(57) ABSTRACT

The present invention relates to an apparatus for playing ball sports including softball. More particularly, the present invention relates to an apparatus for deterring the modification of ball bats. The bat comprises a barrel, a sweet spot, a transition area, a handle, and an end knob. Within the barrel are found supports used to reinforce the structural integrity of the bat to deter users from crushing the bat, causing the bat to fall outside the legal classification of bats allowed by the Amateur Softball Association of America (ASA). The supports are made out of a lightweight durable composition. The supports are held in place by a retaining member. Multiple supports and retaining members may be used.

26 Claims, 7 Drawing Sheets

FIG. 6
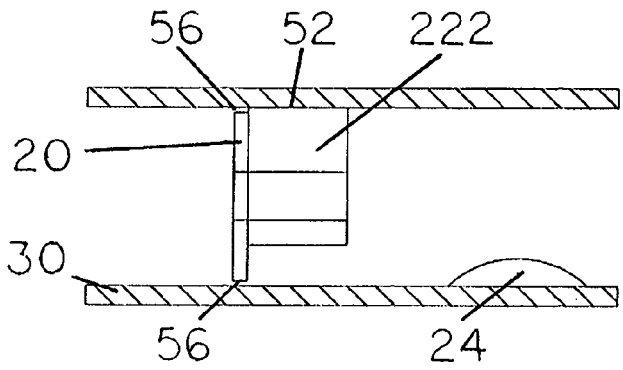
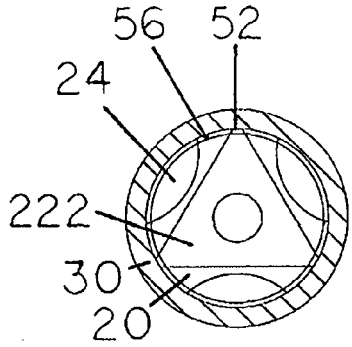
FIG. 7
FIG. 8
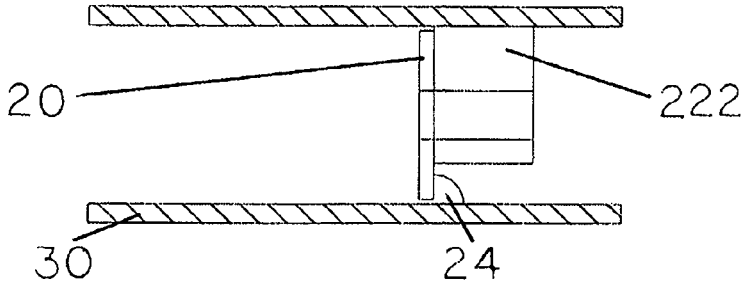
FIG. 9
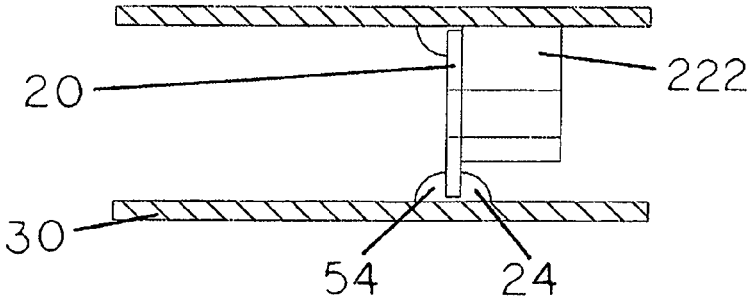

APPARATUS FOR DETERRING MODIFICATION OF SPORTS EQUIPMENT

This continuation application claims the benefit of U.S. patent application Ser. No. 12/315,485, entitled APPARATUS FOR DETERRING MODIFICATION OF SPORTS EQUIPMENT, to George W. Burger, filed Dec. 3, 2008 now U.S. Pat. No. 7,850,554.

BACKGROUND OF THE INVENTION (a) Field of the Invention

The present invention relates to an apparatus for playing ball sports, such as, for example, softball. More particularly, the present invention relates to an apparatus for deterring the modification of ball bats.

(b) Background of the Invention

In the field of ball bat technology, a known problem is "rolling". An issue presently exists in softball where players will purchase a softball bat and then modify that bat such that its performance ability is altered and may exceed the standards of the Amateur Softball Association of America (ASA). Persons will perform a process known as "rolling" where they will take a fiber bat and "squeeze" the barrel between large rolling tubes separated by a distance smaller than the diameter of the bat being rolled. The bat is rolled back and forth between these tubes fracturing fibers within the bat so that the bat becomes softer and more elastic. A bat that is so rolled is referred to as "hot" because it has the capacity to send the ball from the bat at a faster pace than a bat not so rolled. Certain regulations are in place under the ASA that make such rolled bats improper for use in any ASA regulated competition. Tests are conducted under the authority of the ASA to determine the rate of speed at which a ball will exit a bat when struck by a batter. Those bats with exit speeds in excess of 98 miles per hour (mph) when using the ASTM F2219 standard test method are illegal under the current rules of the ASA.

The Inventor is not aware of any prior art addressing the problem of deterring any portion of a ball bat from being rolled.

SUMMARY OF THE INVENTION

The present invention addresses the shortcomings of the prior art and provides, among other things, a bat which deters the modification of the bat so that the user is capable of hitting the ball further or at a pace faster than permitted within the official rules of the game.

A need exists for deterring the modification of ball bats, namely to deter rolling. The present invention discloses a bat that includes one or more supports inside of the bat oriented in such a way as to reinforce the integrity of the bat from the interior. The present invention contemplates using a retaining member to position at least one support within the bat transverse to the bat's axis to provide integrity to the bat's composition to deter rolling. Multiple retaining members and supports are preferably employed.

The primary objective of the present invention is to minimize the ability to alter the elasticity of the bat through the process of fracturing fibers within the bat, thereby creating a hot bat. The bat is characterized in that it comprises an outer shell, preferably of fiberglass, graphite, or composite materials. The ball bat is reinforced from the center using supports transverse to bat's axis. The supports of the present invention are composed of a resilient material with little or no elasticity thereby providing the maximum structural integrity to the bat. The supports are held into place using a retaining member, such as a urethane foam member, that slides into the interior of the bat. When a support is in a desired location in the bat, the retaining member, support, or both are adhered to the interior of the bat using an adhesive such as glue, urethane, or silicone.

The present invention will provide maximum structural integrity to the interior of the bat while continuing to provide a bat with sufficient elasticity for batters to adequately play the sport within the rules of the game.

More particularly, the present invention is a ball bat having a barrel with a cavity inside, a support and a retaining member. The support and retaining member are located inside the cavity, and the retaining member positions the support within the cavity.

Even more particularly, the retaining member positions the support transverse to the long axis of the bat. The retaining member may have a notch in which the support is retained.

Even more particularly, the support is composed of a lightweight resilient material, such as graphite or magnesium. The retaining member may be cylindrical or may be a non-circular geometric shape with at least three contact points and is often composed of urethane foam.

The ball bat may include one retaining member positioning one support member. The ball bat may also include two or more retaining members, each positioning one or more support members. Alternatively, the ball bat may include a single retaining member that positions two or more supports.

BRIEF DESCRIPTION OF THE DRAWINGS

A better understanding of the present invention will be had upon reference to the following description in conjunction with the accompanying drawings, wherein:

FIG. 6 shows a cross section of a barrel, sliced lengthwise, having a support that is not in its final location;

FIG. 7 shows a cross section of a barrel, sliced along the width, having a support that is not in its final location;

FIG. 8 shows a cross section of a barrel, sliced lengthwise, having a support that is in its final location; and FIG. 9 shows a cross section of a barrel, sliced lengthwise, having a support that is in its final location.

DETAILED DESCRIPTION OF THE PREFERRED EMBODIMENT

Figure 1A:
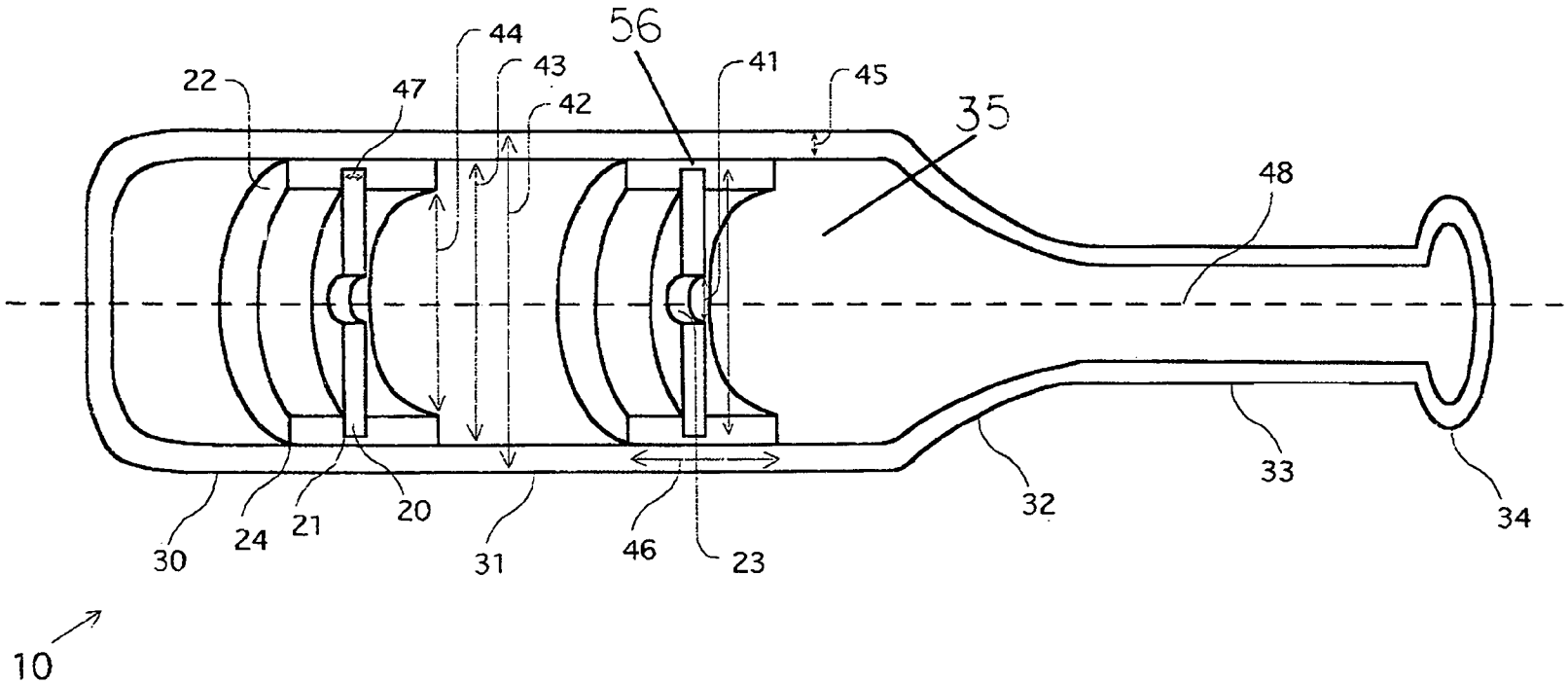
FIG. 1*a* shows a cross section of a bat, sliced lengthwise, having 2 support and retaining member components.
Figure 1B:
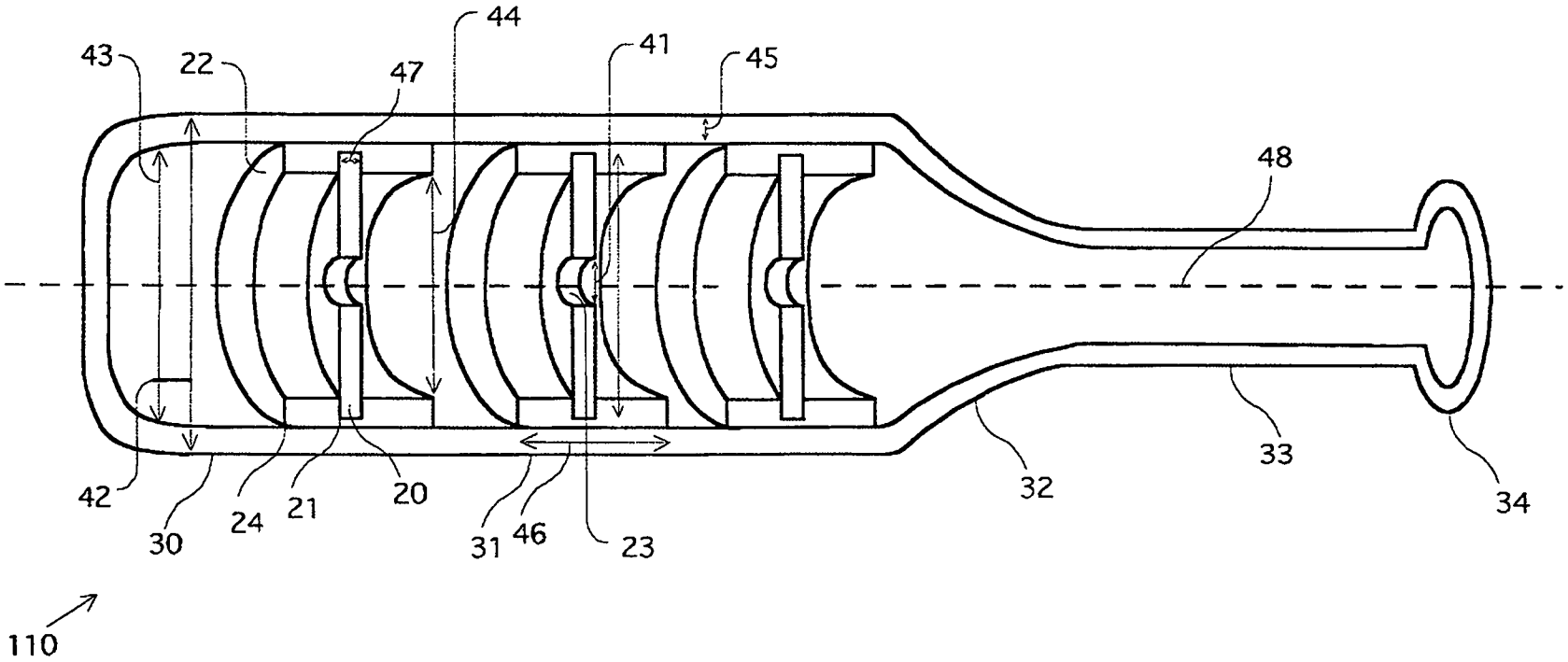
FIG. 1*b* shows a cross section of a bat, sliced lengthwise, having 3 support and retaining member components.
Figure 1C:
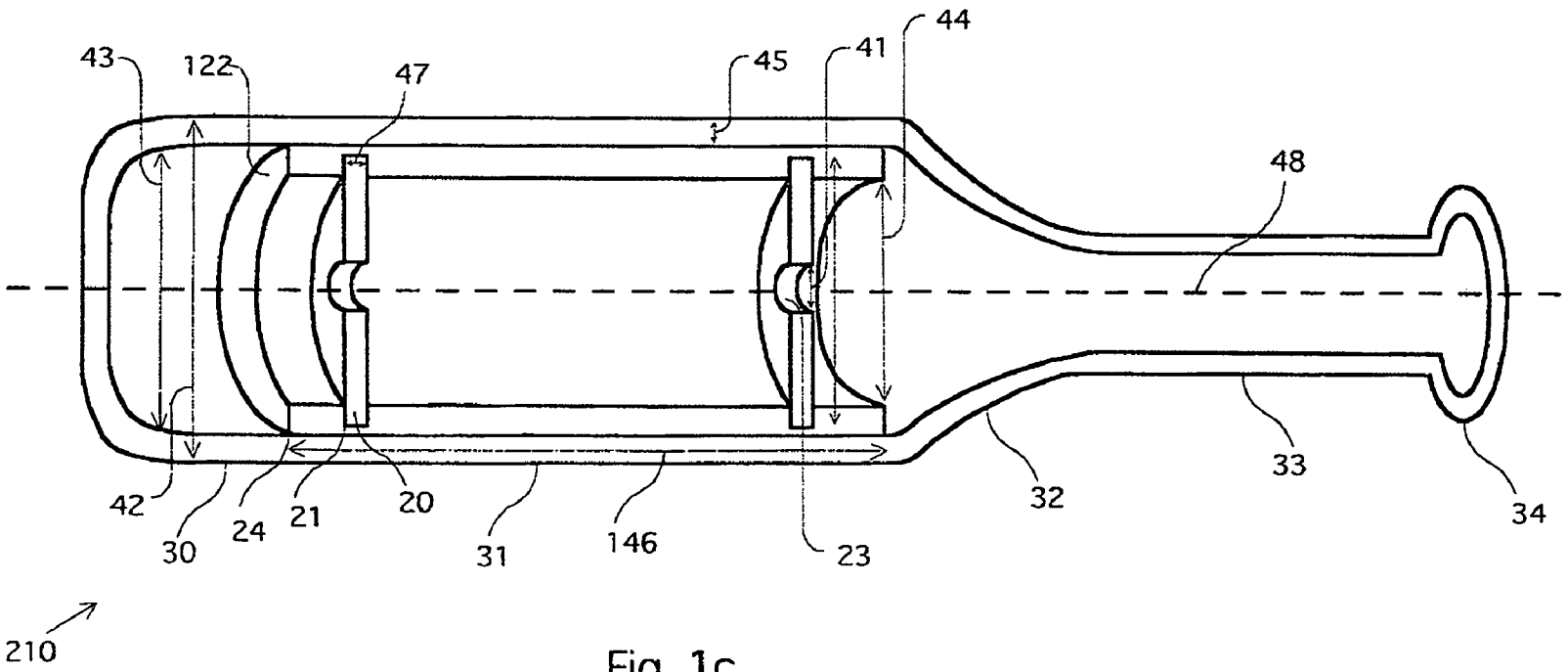
FIG. 1*c* shows a cross section of a bat, sliced lengthwise, having 2 support components and 1 retaining member component.
Figure 2:
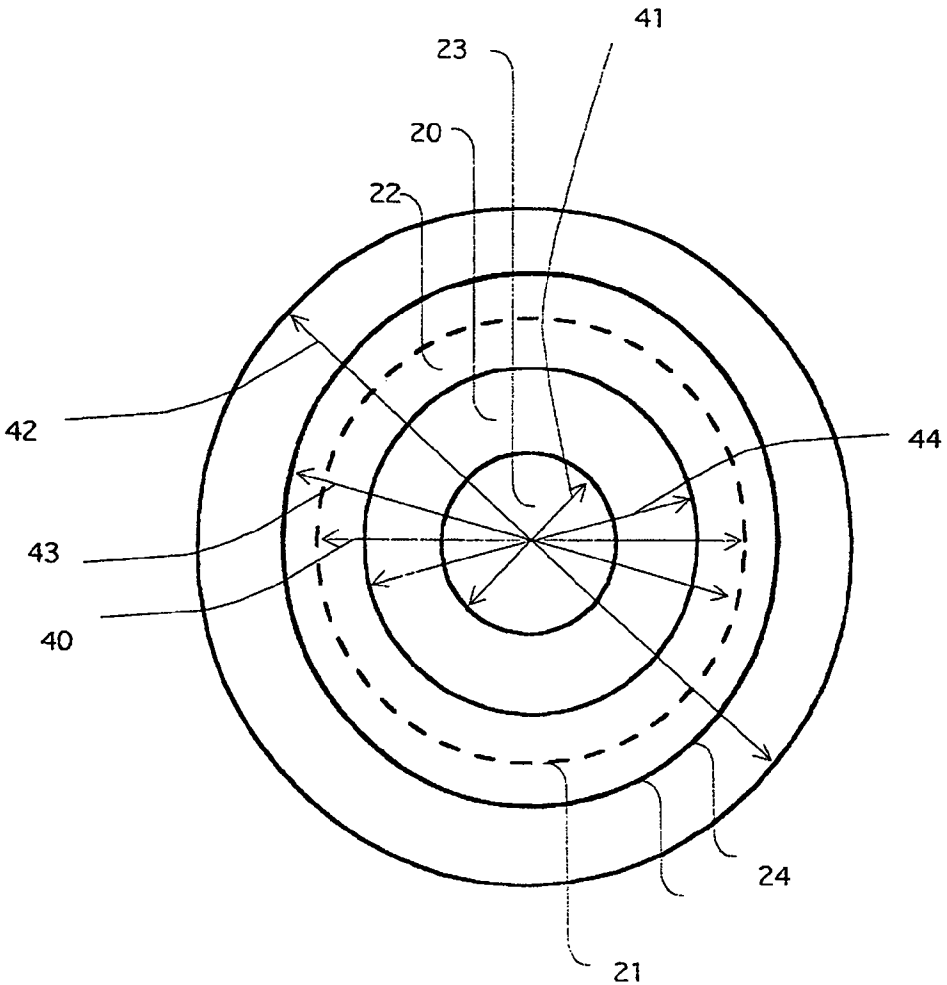
FIG. 2 shows a second cross section of a bat, sliced along the width.
Figure 3:
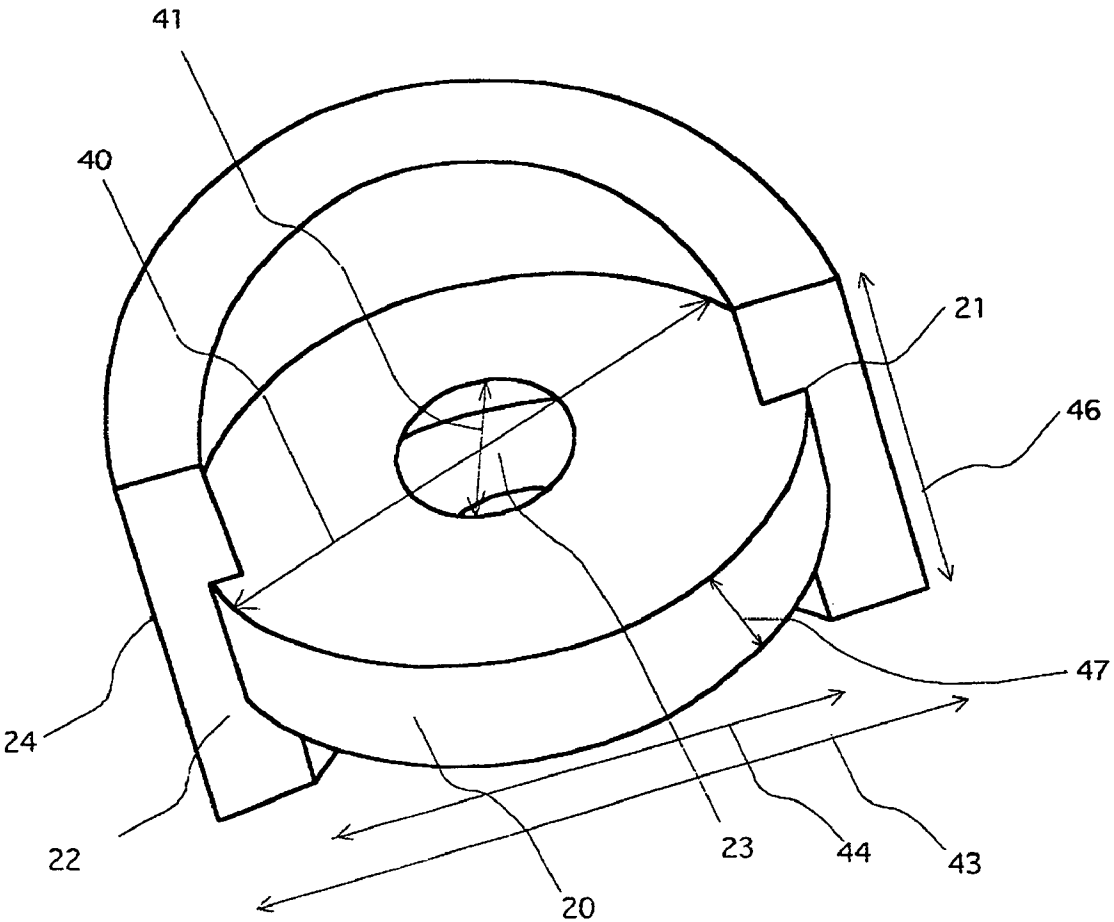
FIG. 3 shows a portion of a retaining member with a support inserted into a notch.

Referring now to FIGS. 1-3, the bat 10 embodied in the present invention is shown comprising a barrel 30, a sweet spot 31, a transition area 32, a handle 33, and an end knob 34. A preferred embodiment of the present invention is bat 10 having a barrel 30 of constant outer diameter 42 of 2.25 inches (5.72 cm) and an inner diameter 43 of 1.85 inches (4.70 cm), and having a barrel wall thickness 45 of 0.2 inches (0.51 cm).

The composition of the bat 10 is preferably continuous throughout, including the barrel 30, the sweet spot 31, the transition area 32, the handle 33 and the end knob 34. Alternative bat 10 constructions are known where the end knob 34 is a separate component attached to the handle 33. Also, the barrel 30 may have a separate end cap. Even further, the bat 10 may be composed of a composite material or a metal/composite combination, as is known in the art.

The bat 10 has a sweet spot 31 that is an area at the center of percussion where the contact between bat 10 and ball results in the "best hit." More particularly, the sweet spot 31 is where the maximum energy is transferred to the ball when struck, the ball leaves the bat 10 with the greatest speed, and the player's hands feel the least vibration from the impact. The center of the sweet spot 31 is typically five to seven inches (12.7 to 17.8 cm) down from the top of the barrel 30 and extending two inches (5.08 cm) to either side.

The novel aspect of the present invention occurs within the cavity 35 bounded by the inner diameter of the barrel. A retaining member 22 is inserted into the cavity 35. In a preferred embodiment, the retaining member 22 is aligned with the barrel 30 and incorporates one notch 21 allowing one support 20 to be inserted into said notch 21, positioning the support transverse to bat's 10 axis 48. The retaining member 22 is cylindrical in shape so that it may be inserted into the barrel 30. The retaining member 22 has an outer diameter 43 preferably equal to the inner diameter 43 of the barrel 30 so as to permit the retaining member 22 to fit snugly against the inner wall of the barrel 30 to prevent slippage. In an embodiment with the bat 10 having an inner diameter 43 of 1.85 inches (4.70 cm), the retaining member 22 will have an outer diameter 43 of 1.85 inches (4.70 cm), an inner diameter 44 of 1.6 inches (4.06 cm), and a length 46 of 1 inch (2.54 cm). Preferably one support 20 is positioned about two inches (5.08 cm) on each side of the center of the sweet spot 31. Therefore, the supports 20 are separated by a distance of about four inches (10.16 cm), as depicted in FIG. 1*a*.

As is shown in FIG. 1*b*, another embodiment of the present invention the bat 110 preferably includes three supports 20 with one positioned at the center of the sweet spot 31 and one approximately two inches (5.08 cm) on either side of the center of the sweet spot 31. The support 20 located at the sweet spot 31 being constructed such that the bat 110 cannot be rolled.

In an alternative embodiment, FIG. 1*c* shows bat 210 with the retaining member 122 having a plurality of notches 21 for which multiple supports 20 may be inserted to provide structural integrity to the interior of the bat 210. In this alternative embodiment, the retaining member 122 would be approximately 5 inches (12.7 cm) in length 146.

The supports 20 of the present invention should be of a lightweight resilient composition to prevent a "weighting" effect on the bat 10. Some weighted bats are improper under ASA guidelines. The supports 20 may, for example, be composed of any material suitable to prevent rolling the bat 10, such as graphite or magnesium. In a preferred embodiment, the supports are disk-shaped.

Some embodiments of the present invention utilize the durability and structural integrity of graphite to reinforce the interior cylinder of the barrel. Graphite is a resilient material capable of resisting compression and fracturing in the rolling process. The orientation of the grain within the graphite should be structured so as to provide maximum integrity for all 360 degrees of the bat 10 such that the bat 10 cannot be rolled in any direction. The supports 20 of the present invention will preferably be constructed of 16 to 24 plies of graphite, and approximately one eighth of an inch (3.18 mm) in total thickness 47. For the bat 10 with an inner diameter 43 of 1.85 inches (4.70 cm), these supports 20 will be disks composed of solid graphite having an outer diameter 40 of 1.75 inches (4.45 cm) and, as is explained hereafter, preferably include a center hole 23 having an inner diameter 41 of 0.625 inches (1.59 cm). However, supports 20 without a hole 23 or in shapes other than disks could be used.

The supports 20 of the present invention will preferably include a hole 23 in the center so that a liquid may be poured through the center of the supports in the bat 10 manufacturing process. Thus, in embodiments using disk-shaped supports 20, the supports 20 of the present invention will resemble washers.

The supports 20 should be designed in such a way that they will not cause dead zones within the bat 10. Dead zones are areas in the bat with extremely low levels of elasticity. The lower the elasticity, the less propulsion effect the bat will have on the ball. In the instance of ball bats, a dead zone is an area where the energy from the ball-to-bat contact is transferred to the bat rather than to the ball. The present invention will allow a manufacturer to determine the elasticity of the bat, such that it will be acceptable under ASA guidelines.

The supports 20 are designed to have an outer diameter 40 slightly smaller than the inner diameter 43 of the bat 10. In one embodiment, the outer diameter 40 is 1.75 inches (4.45 cm) and the inner diameter 43 is 1.85 inches (4.70 cm). Thus, in this embodiment, a gap 56 of 0.05 inches (1.27 mm) will be present between the supports 20 and the bat 10. This gap 56 is necessary to allow the bat 10 to "hoop bend" without the hoop bend being inhibited by the support 20. A hoop bend is a slight temporary deformation of the bat 10 when it impacts a ball.

The retaining member 22 of the present invention must be reinforced sufficiently to prevent the force of repeated strikes of the bat 10 from knocking the supports 20 loose within the barrel 30 of the bat 10. The notches 21 made within the retaining member 22 must be deep enough to prevent the supports 20 from coming loose when the bat 10 is used. In a preferred embodiment, the retaining member 22 is composed of urethane foam of sufficient stiffness to maintain the supports 20 in a position transverse to the axis 48 of the bat 10.

In a first embodiment, the retaining member 22 of the present invention is inserted into the barrel 30 and when the supports 20 is at the final location, the retaining member 22 is adhered to the interior of the barrel 30 with an adhesive 24. In this first embodiment, the retaining member 22 is cylindrical. Any means for adhesion may be used, but preferably the means will be urethane or silicone.

Figure 4:
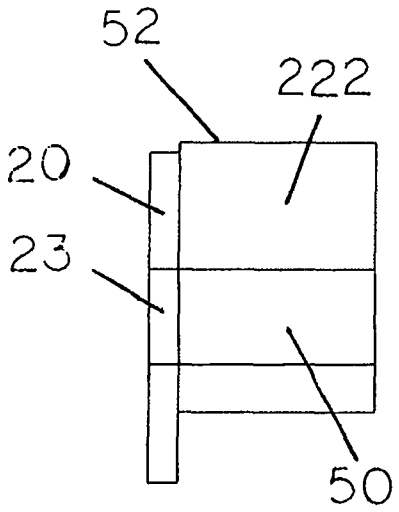
FIG. 4 shows a cross section of a retaining member with a support along the lines 4-4 shown in FIG. 5.
Figure 5:
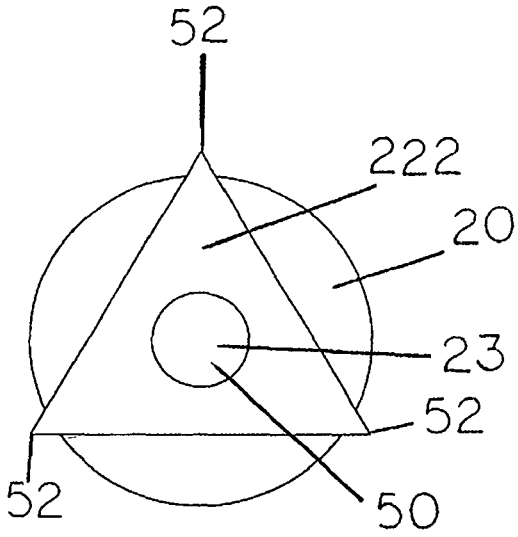
FIG. 5 shows a transverse view of a retaining member with a support.

In a second embodiment, retaining member 222 is a non-circular geometric shape having at least three contact points 52, as shown in FIG. 4 and FIG. 5. In this second embodiment, the retaining member is sized so that the contact points 52 contact the interior of the barrel 30, as shown in FIG. 7. The retaining member 222 has a hole 50. In this second embodiment, the means of adhesion 24 is positioned at the final location of the support 20, as shown in FIG. 6. In this second embodiment, the means of adhesion 24 is positioned such that the means of adhesion 24 will not contact the retaining member 222, as shown in FIG. 7. The retaining member 222 of the present invention is inserted into the barrel 30 until the support 20 contacts the means of adhesion 24 at the final location of the support 20, as shown in FIG. 8. Additional means of adhesion 54 is then added to adhere the entire perimeter of the support 20 to the interior of the barrel 30, as shown in FIG. 9. Any means for adhesion may be used, but preferably the means will be urethane or silicone.

The retaining member 22 of the present invention must not be resistant to the adhesive 24. The retaining member 22 of the present invention will preferably be of a lightweight composition to prevent a "weighting" effect. In a preferred embodiment, the retaining member 22 will be of a lightweight composition capable of being adhered to the interior of the bat 10, such as urethane foam.

The bat 10 of the present invention may be included in one-wall or multiple-wall bat technology.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A ball bat comprising:

a barrel having a cavity therein, said barrel including a long axis and an inner diameter;

a generally disc-shaped support inserted inside said cavity, said support including an outer diameter less than said inner diameter, such that, as inserted, said support does not directly contact said barrel; and a retaining member inserted inside said cavity, whereby said retaining member positions said support transverse to said long axis;

wherein said support is composed of a lightweight resilient material capable of resisting compression and fracturing during rolling and wherein said support is sized to not inhibit deformation of said ball bat when a batter uses said ball bat to strike a ball.

2. The ball bat of claim 1, wherein said retaining member is cylindrical and sized to fit snugly within said cavity.

3. The ball bat of claim 2, wherein said retaining member is adhered to said barrel with an adhesive.

4. The ball bat of claim 1, wherein said support is one of a plurality of supports.

5. The ball bat of claim 1, wherein said retaining member is one of a plurality of retaining members.

6. The ball bat of claim 5, wherein said support is one of a plurality of supports and each of said plurality of retaining members positions one of said plurality of supports within said cavity.

7. The ball bat of claim 1, wherein said support is composed of one of magnesium and graphite.

8. The ball bat of claim 1, wherein structural characteristics of said support are selected to maximize structural integrity of said ball bat.

9. The ball bat of claim 1, wherein said retaining member is composed of urethane foam.

10. The ball bat of claim 1, wherein said support includes a hole.

11. The ball bat of claim 1, wherein said barrel further comprises a sweet spot.

12. The ball bat of claim 11, wherein said support is two supports positioned on either side of said sweet spot.

13. The ball bat of claim 11, wherein said support is three supports: one support positioned at said sweet spot and one positioned on either side of said sweet spot.

14. The ball bat of claim 1, further comprising a gap between said support and said barrel.

15. The ball bat of claim 1, wherein said outer diameter of said support is about 95% of said inner diameter of said barrel.

16. The ball bat of claim 1, wherein said outer diameter of said support is about 0.10 inches less than said inner diameter of said barrel.

17. The ball bat of claim 1, wherein said retaining member is a non-circular geometric shape having at least three contact points for contacting said barrel.

18. The ball bat of claim 17, wherein said support is affixed to said barrel via an adhesive.

19. The ball bat of claim 18, wherein said retaining member includes a hole, and wherein said support includes a hole.

20. The ball bat of claim 18, wherein said barrel further comprises a sweet spot.

21. The ball bat of claim 20, wherein said support is two supports positioned on either side of said sweet spot.

22. The ball bat of claim 20, wherein said support is three supports: one support positioned at said sweet spot and one positioned on either side of said sweet spot.

23. The ball bat of claim 18, wherein said adhesive is one of urethane and silicone.

24. A ball bat comprising:

a barrel having a cavity therein, said barrel including a long axis and an inner diameter;

a generally disc-shaped support inserted inside said cavity, said support including an outer diameter less than said inner diameter, such that, as inserted, said support does not directly contact said barrel, and wherein said support is affixed to said barrel via an adhesive; and a retaining member inserted inside said cavity, whereby said retaining member positions said support transverse to said long axis, said retaining member having a non-circular geometric shape having at least three contact points for contacting said barrel;

wherein said support is composed of a lightweight resilient material capable of resisting compression and fracturing during rolling, and wherein said adhesive is positioned such that it contacts said support and said barrel, but does not contact said retaining member.

25. A ball bat comprising:

a barrel having a cavity therein, said barrel including a long axis and an inner diameter;

a plurality of generally disc-shaped supports inserted inside said cavity, said supports each including an outer diameter less than said inner diameter, such that, as inserted, said supports do not directly contact said barrel; and a retaining member inserted inside said cavity, whereby said retaining member positions said supports transverse to said long axis;

wherein said supports are composed of a lightweight resilient material capable of resisting compression and fracturing during rolling, and wherein said supports are one of: two supports positioned on either side of said sweet spot and three supports, one positioned at said sweet spot and one positioned on either side of said sweet spot.

26. A ball bat comprising:

a barrel having a cavity therein, said barrel including a long axis, an inner diameter, and a sweet spot;

a generally disc-shaped support inserted inside said cavity, said support including an outer diameter less than said inner diameter, such that, as inserted, said support does not directly contact said barrel; and a retaining member inserted inside said cavity, whereby said retaining member positions said support transverse to said long axis, said retaining member having a triangular geometric shape having three contact points for contacting said barrel;

wherein said support is composed of a lightweight resilient material capable of resisting compression and fracturing during rolling.

* * * * *